US011549280B1

(12) United States Patent
Walker

(10) Patent No.: US 11,549,280 B1
(45) Date of Patent: Jan. 10, 2023

(54) FENCING SYSTEM AND METHOD

(71) Applicant: Steven Walker, Mona, UT (US)

(72) Inventor: Steven Walker, Mona, UT (US)

( * ) Notice: Subject to any disclaimer, the term of this patent is extended or adjusted under 35 U.S.C. 154(b) by 181 days.

(21) Appl. No.: 16/900,835

(22) Filed: Jun. 12, 2020

(51) Int. Cl.
*E04H 17/16* (2006.01)
*E04H 17/22* (2006.01)

(52) U.S. Cl.
CPC ..... *E04H 17/165* (2013.01); *E04H 17/22* (2013.01)

(58) Field of Classification Search
CPC ... E04H 17/165; E04H 17/22; E04H 17/1447; E04H 17/1486; E04H 17/1465; E04H 17/1413
USPC ..... 256/24
See application file for complete search history.

(56) References Cited

U.S. PATENT DOCUMENTS 5,192,056 A * 3/1993 Espinueva ..... E04H 17/1447 256/65.06
5,702,090 A * 12/1997 Edgman ..... E04H 17/1447 256/65.02
5,938,184 A * 8/1999 DeSouza ..... E04H 17/1417 256/65.06
5,984,044 A * 11/1999 Christensen ..... E01F 8/0023 181/210
6,398,193 B1 * 6/2002 DeSouza ..... E04H 17/1447 256/65.06
6,464,209 B2 * 10/2002 Meis ..... E06B 11/02 256/73
6,543,751 B1 * 4/2003 Spruill ..... E04H 17/1413 403/384
6,772,998 B2 * 8/2004 Bebendorf ..... E04H 17/168 256/65.11
8,561,371 B2 * 10/2013 Sanders ..... E04B 1/14 52/764
10,221,529 B1 * 3/2019 Sanders ..... H02G 3/386
10,718,133 B1 * 7/2020 Maher ..... E04H 17/165
2002/0023406 A1 * 2/2002 Pettit ..... E04F 11/181 52/832
2003/0213947 A1 * 11/2003 Takagi ..... E04H 17/168 256/65.02
2006/0180802 A1 * 8/2006 Forbis ..... E04H 17/1417 256/24
2007/0158629 A1 * 7/2007 Laws ..... E04H 17/168 256/24
2017/0058557 A1 * 3/2017 Wu ..... E04H 17/22
2019/0284833 A1 * 9/2019 Yeh ..... E04H 17/168
2020/0318383 A1 * 10/2020 Feng ..... E04H 17/1447
2021/0025194 A1 * 1/2021 Walker ..... E04H 17/1417
(Continued)

*Primary Examiner* — Beth A Stephan
(74) *Attorney, Agent, or Firm* — Steven J. Malone

(57) ABSTRACT

A fencing system and method includes: a first vertical post secured at least partially below ground; a second vertical post secured at least partially below the ground; a first rail member having a first slot attached to the first vertical post; a second rail member having a second slot attached to the second vertical post; a third rail member having a third slot; a fourth rail member having a fourth slot; a plurality of generally horizontally arranged cement composite slats positioned in a common plane formed by the first slot and the second slot forming a floating arrangement of horizontally positioned cement composite slats; and wherein the first rail member, the second rail member, the third rail member, and the fourth rail member form a frame for the floating arrangement of horizontally positioned cement composite slats.

20 Claims, 9 Drawing Sheets

(56) References Cited

U.S. PATENT DOCUMENTS

2021/0363712 A1* 11/2021 Wilson ..... E04C 3/07
2021/0395964 A1* 12/2021 Wilson ..... E01F 8/0023

* cited by examiner

FENCING SYSTEM AND METHOD

FIELD OF THE INVENTION

The present invention discloses a fencing system and method.

BACKGROUND

Traditional materials used in fencing have several drawbacks such as durability, discoloration, and difficulty in installation.

Vinyl fences can warp under extreme temperatures and their own weight and discolor over time. The durability and coloration of wood fences can be affected over time by weather damage and wood-boring insects. Metal fences are not very good for privacy and can rust. Cement fences are durable but lack the warm and homey look of wood. Cement fences are also difficult to install and difficult to remove needing a whole crew of people to install and disassemble them.

Thus there is a need for a fencing system that is durable, rust resistant, not prone to warping, and is easier to install than cement. Additionally, there is a need for a fencing system that is low maintenance and insect proof while maintaining the warm and attractive features of wood.

SUMMARY

A fencing system and method includes: a first vertical post secured at least partially below ground; a second vertical post secured at least partially below the ground; a first rail member having a first slot attached to the first vertical post; a second rail member having a second slot attached to the second vertical post; a third rail member having a third slot; a fourth rail member having a fourth slot; a plurality of generally horizontally arranged cement composite slats positioned in a common plane formed by the first slot and the second slot forming a floating arrangement of horizontally positioned cement composite slats; and wherein the first rail member, the second rail member, the third rail member, and the fourth rail member form a frame for the floating arrangement of horizontally positioned cement composite slats.

The plurality of generally horizontally arranged cement composite slats may have a width of between 0.25 of an inch and 2 inches. The first slot, the second slot, the third slot, and the fourth slot may have a width of between 0.30 of an inch and 2.25 inches. The fencing system may further comprise: a first facing member and a second facing member, wherein the first facing member and the second facing member may each provide an interface between the frame and the first vertical post. The fencing system may further comprise a third facing member and a fourth facing member, wherein the third facing member and the fourth facing member may each provide an interface between the frame and the second vertical post. The first slot and the second slot may be attached to the first vertical post and the second vertical post by way of one or more fasteners protruding through one or more holes in the first slot and through one or more holes in the second slot. The first vertical post may have a fifth rail member having a fifth slot attached to the first vertical post. The first vertical post may have a sixth rail member having a sixth slot attached to the first vertical post. The first vertical post may have a seventh rail member having a seventh slot attached to the first vertical post. The second vertical post may have an eighth rail member having an eighth slot attached to the second vertical post. The second vertical post may have a ninth rail member having a ninth slot attached to the second vertical post. The second vertical post may have a tenth rail member having a tenth slot attached to the second vertical post. The fencing system of the claims, wherein the first rail member and the second rail member are cement composite materials. The third rail member and the fourth rail member may be cement composite materials. The first facing member and the second facing member may be cement composite materials. The third facing member and the fourth facing member may be cement composite materials. The first vertical post and the second vertical post may be cemented into the ground. The first rail member and the second rail member may be cement composite materials formed with one or more embedded metal fasteners. The third rail member and the fourth rail member may be cement composite materials formed with one or more embedded metal fasteners. The plurality of generally horizontally arranged cement composite slats may directly touch adjacent slats to form the floating arrangement.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
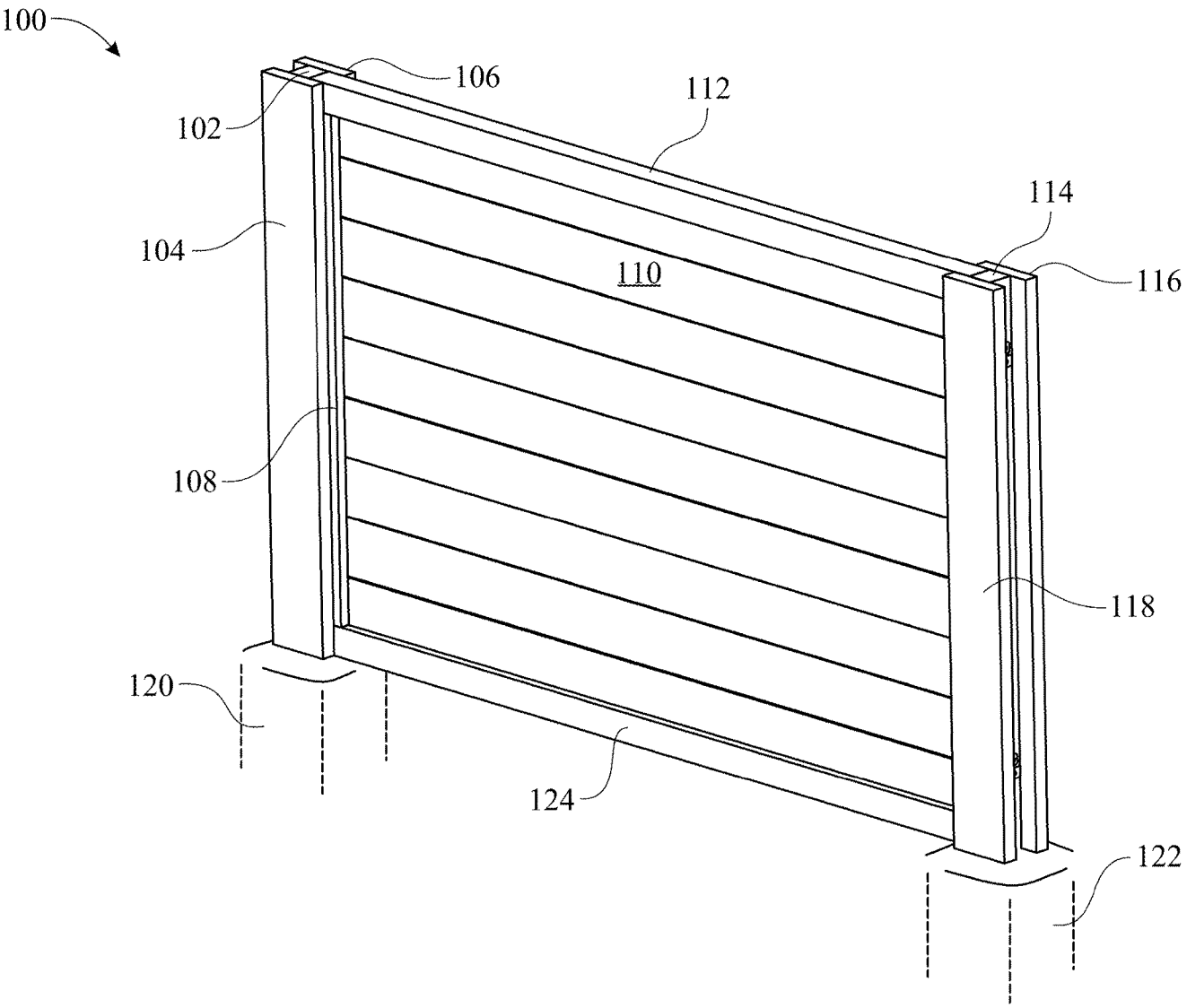
FIG. 1 shows a perspective view of a fencing system and method in accordance with an embodiment of the invention.

FIG. 1 shows a section 100 of a fencing system and method in accordance with an embodiment of the invention. Fence section 100 includes a first vertical post 102 secured at least partially above ground and at least partially below ground, cement 120, a second vertical post 114 secured at least partially above ground and partially below ground, cement 122, a first rail member 108 having a first slot (visible in FIG. 3), a second rail member having a second slot (shown in FIG. 3), a first facing member 104 and a second facing member 106, a third facing member 118 and a fourth facing member 116, a third rail member 112 having a third slot (visible in FIG. 3), a fourth rail member 124 having a forth, and a plurality of generally horizontally arranged cement composite slats 110. The first facing member 104 and the second facing member 106 may each provide an interface between the frame 112/124/108/309 and the first vertical post. First and second vertical posts 102/114 may be secured in ground using cement 120/122 or other know post hole securing means. Posts 102/114 may be constructed from one or more materials including steel, steel alloys, aluminum, aluminum alloys, wood, wood product, concrete, concrete products, carbon fiber, polymer based products, or a combination thereof.

Figure 2:
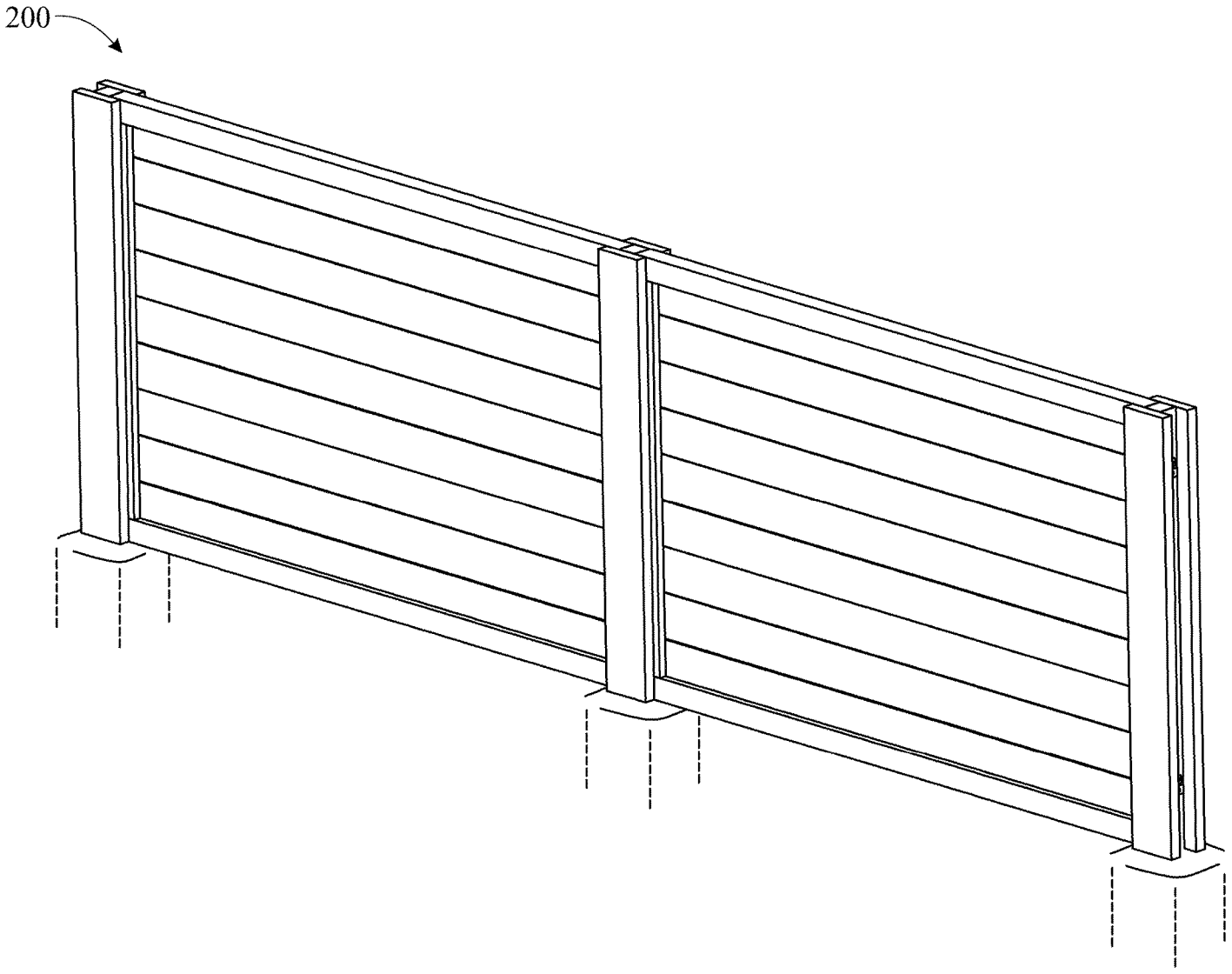
FIG. 2 shows a perspective view of a fencing system and method in accordance with an embodiment of the invention.

In FIG. 2, multiple fencing sections 200 are shown of a fencing system and method in accordance with an embodiment of the invention. Multiple fencing sections 200 may be foiled in a straight line as shown in FIG. 2 or may be built at various angles according to fencing need.

Figure 3:
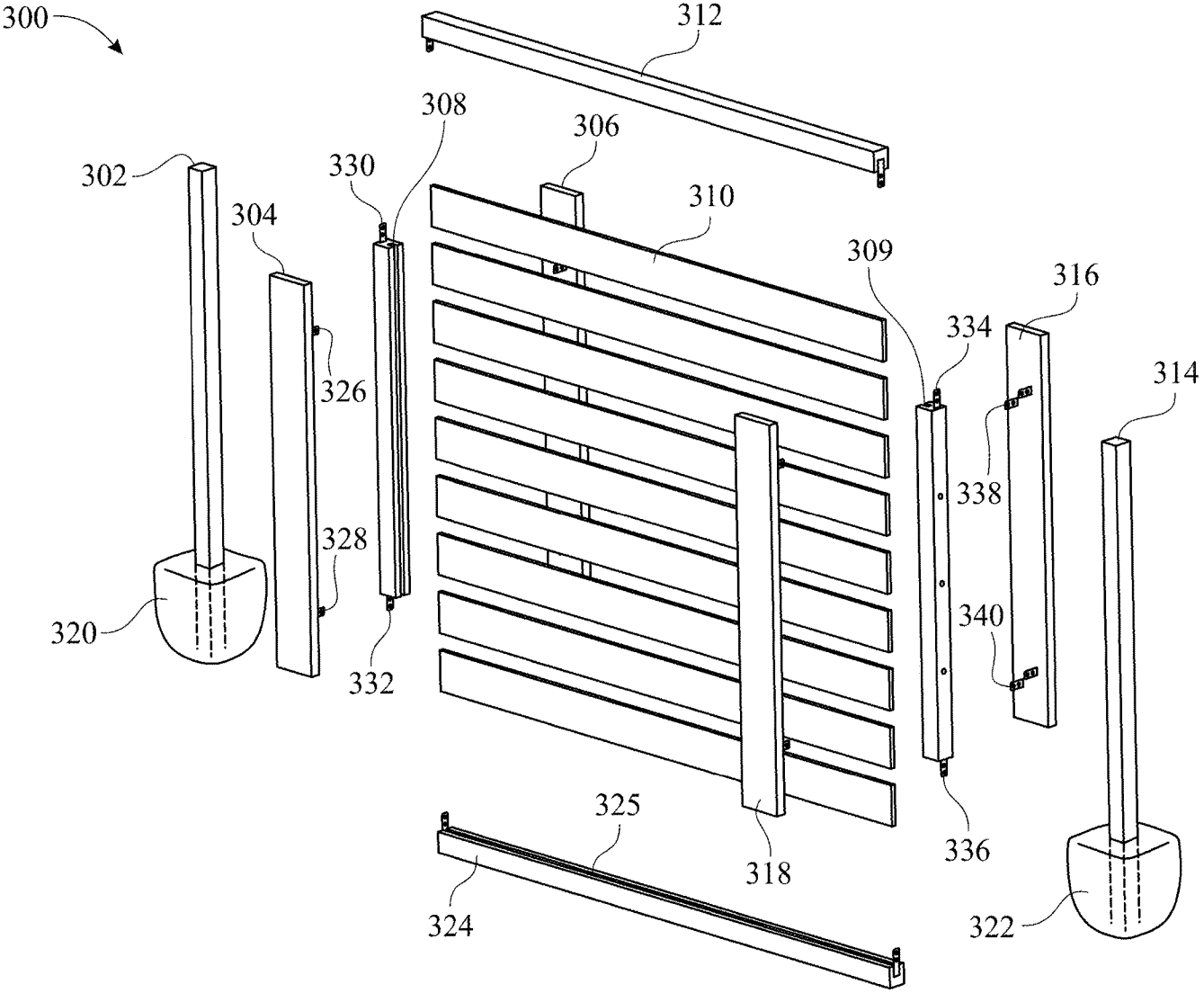
FIG. 3 shows an exploded view of a fencing system and method in accordance with an embodiment of the invention.

FIG. 3 shows an exploded view of a fencing section 300 of a fencing system and method in accordance with an embodiment of the invention. Fence section 300 includes a first vertical post 302 secured at least partially above ground and at least partially below ground using poured cement 320. A second vertical post 314 is secured at least partially above ground and partially below ground using poured cement 322. A first rail member 308 having a first slot running the length of rail member 308 is shown facing horizontally arranged cement composite slats 310. Cement composite slats 310 may have a width of between 0.25 of an inch and 2 inches. Slats 310 are assembled into a fencing section by sliding individual slats down a frame portion of rail members. Rail member 308 and 309 provide the tracks on each side allowing the slats 310 to slide onto each other. Bottom rail member 324 and top rail member 312 lock the top and bottom slats in place using slots or rails in the rail members. The ends of slats 310 are designed to protrude into the first and second slots of first and second rail members 308/309. Slots or rails of rail members 308/309/324/312 are wider than a width or thickness of the plurality of cement composite slats 310 allowing the ends of the slats to slide into the slots. Slots of rail members 308/309/324/312 may have a width of between 0.30 of an inch and 2.25 inches. Slot 325 is representative of the slots of rail members 308, 309, 312, and 324. Rail members 308, 309, 324, and 312 may be made out of a similar concrete composite that the slats 310 are made from. Each of rail members 308, 309, 312, and 324 may include one or more metal fasteners 330/332/336/334 as integral components of a concrete pour forming rail member 308, 309, 312, and 324. A first facing member 304 and a second facing member 306, and a third facing member 318 and a fourth facing member 316 may be used to secure the rail members together and/or to the first and second vertical posts 302/314. Slats 310 are not fastened and are free floating in a frame defined by rail members 308/309/312/324. Facing members 304/306/316/318 may be concrete composite components made to include one or more metal fasteners 326/328/338/340 as integral components of a concrete pour formed when the facing member were made. All materials shown in FIG. 3 may be made from concrete composite materials of a similar formulation. In a preferred embodiment, all materials except posts 302 and 314 are made from the same concrete composite material formulation. Posts 302/314 may be constructed from one or more materials including steel, steel alloys, aluminum, aluminum alloys, wood, wood product, concrete, concrete products, carbon fiber, polymer based products, or a combination thereof.

Figure 4:
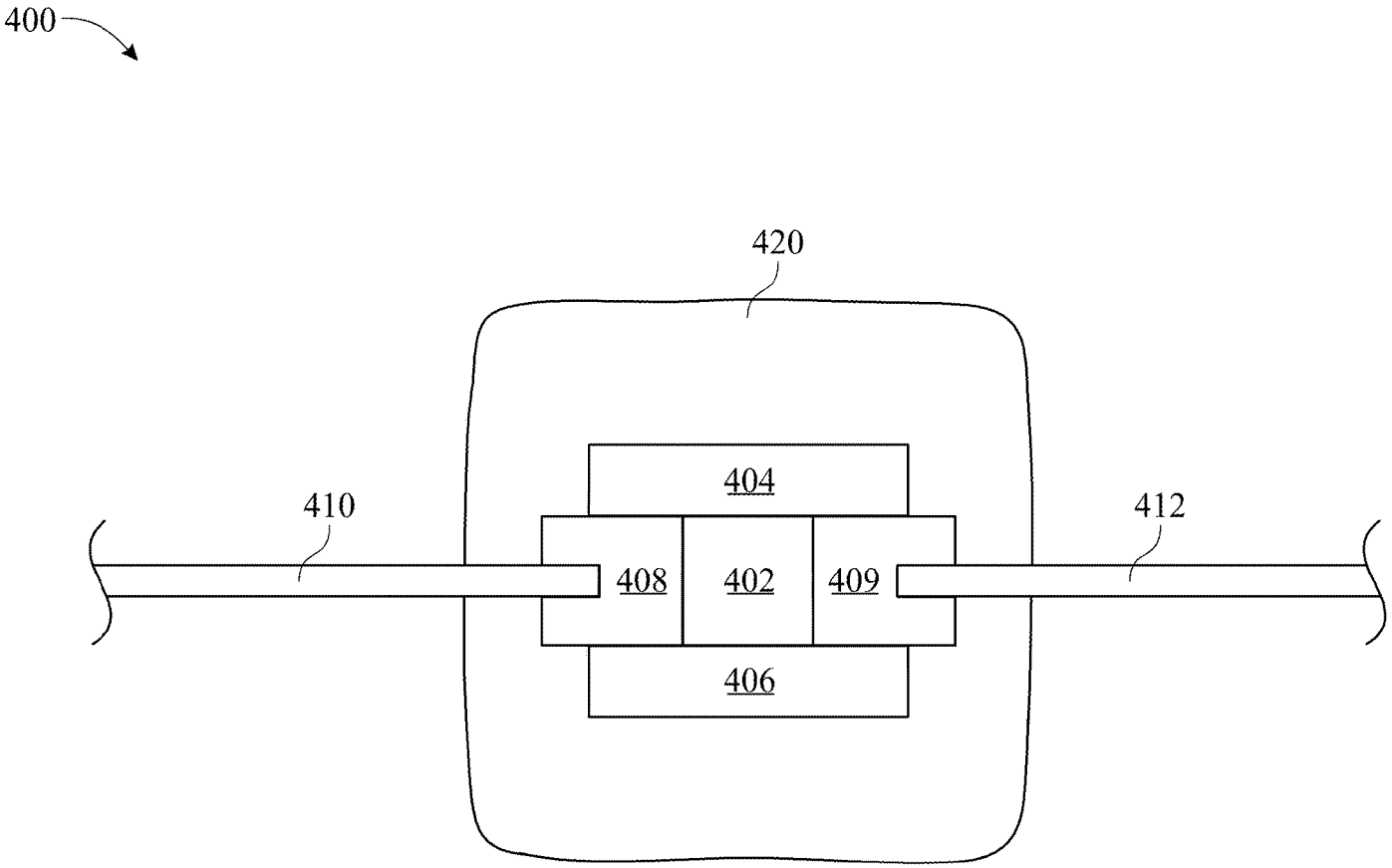
FIG. 4 shows a top view of a fencing system and method in accordance with an embodiment of the invention.

FIG. 4 shows a top view of a fencing intersection 400 of a fencing system and method in accordance with an embodiment of the invention. Fence intersection 400 includes a first vertical post 402 secured at least partially above ground and at least partially below ground using poured cement 420. A first rail member 408 having a first slot running the length of rail member 408 is shown facing horizontally arranged cement composite slats 410. Cement composite slats 410 may have a width of between 0.25 of an inch and 2 inches. The ends of slats 410 are designed to protrude into the first slot of first rail member 408 as shown. Slots of rail members 408 and 409 may be wider than a width or thickness of the plurality of cement composite slats 410 and 412 allowing the ends of the slats to slide into the slots as shown. Slots of rail members 408 and 409 may have a width of between 0.30 of an inch and 2.25 inches. Rail members 408 and 409 may be made out of a similar concrete composite that the slats 410 and 412 are made from. Each of rail members 408 and 409 may include one or more metal fasteners as integral components of a concrete pour forming rail members 408 and 409. Post 402 may be constructed from one or more materials including steel, steel alloys, aluminum, aluminum alloys, wood, wood product, concrete, concrete products, carbon fiber, polymer based products, or a combination thereof. A first facing member 404 and a second facing member 406 may be used to secure the rail members 408/409 together and/or to the first vertical post 402. Slats 410/412 are not fastened and are free floating in a frame defined by surrounding rail members. Facing members 404/406 may be concrete composite components made to include one or more metal fasteners as integral components of a concrete pour formed when the facing member were made. A plurality of rail members, facing members, horizontal slats, and vertical posts may be used in various fencing arrangements contemplated in accordance with the instant invention.

Figure 5:
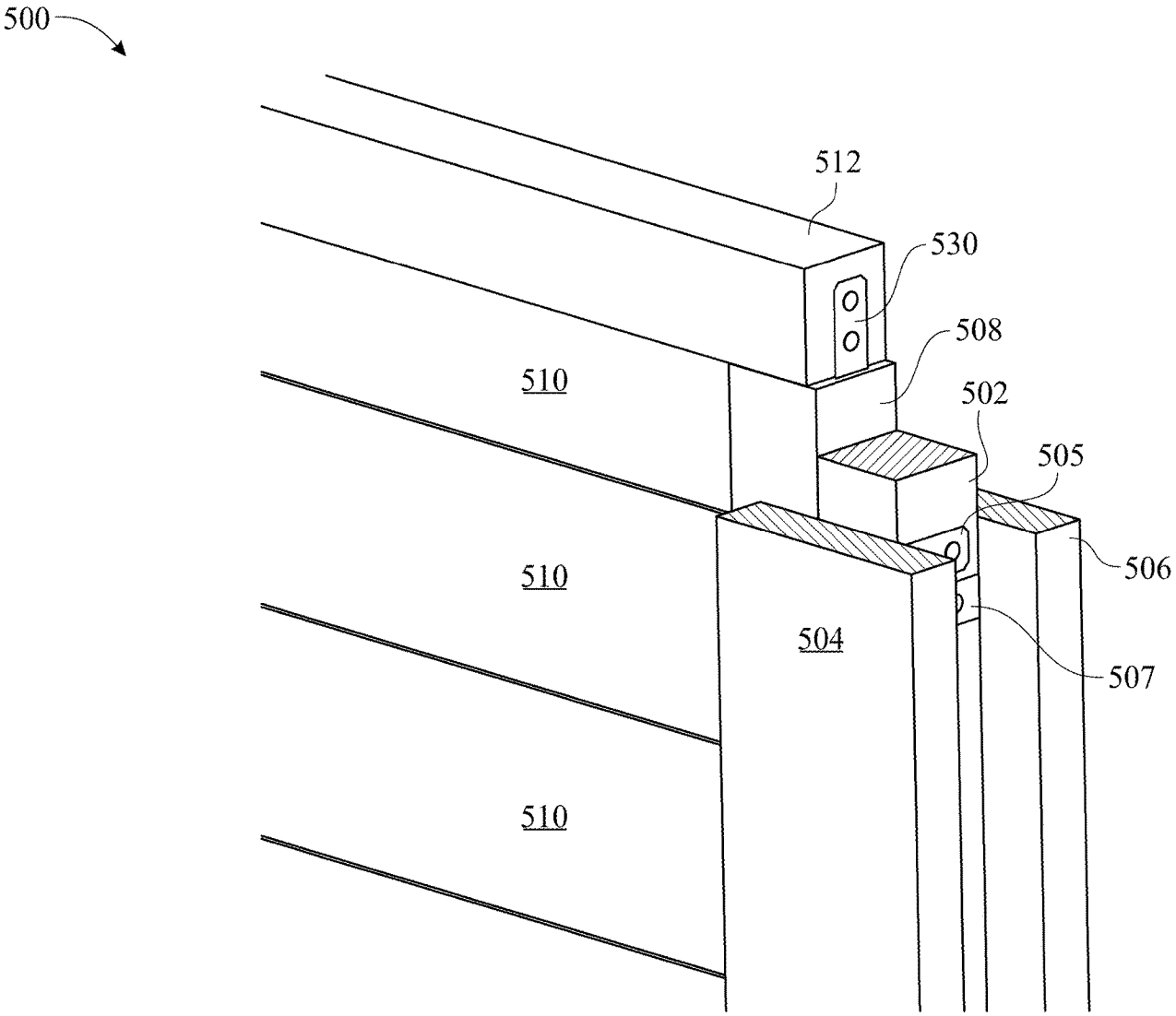
FIG. 5 shows a perspective cut-away view of a fencing system and method in accordance with an embodiment of the invention.

FIG. 5 shows a perspective cutout view 500 of a fencing system in accordance with an embodiment of the invention. Cutout view 500 includes cement composite slats 510 inserted into a rail member 508. Rail member 508 may be screwed into post 502 by way of through holes in rail member 508 (also shown in FIG. 3). Facing boards 504 and 506 may include metal fasteners 505/507 providing a secure connection of the facing boards to post 502. Facing boards 504/506 may be used to secure frame portion 512/508 to post 502. Slats 510 may be free floating within rails or slots of a frame portion defined by rail members 512/508 forming a perimeter around slats 510. Rails members 512 and 508 may include one or more integrally formed metal fasteners 530.

Figure 6:
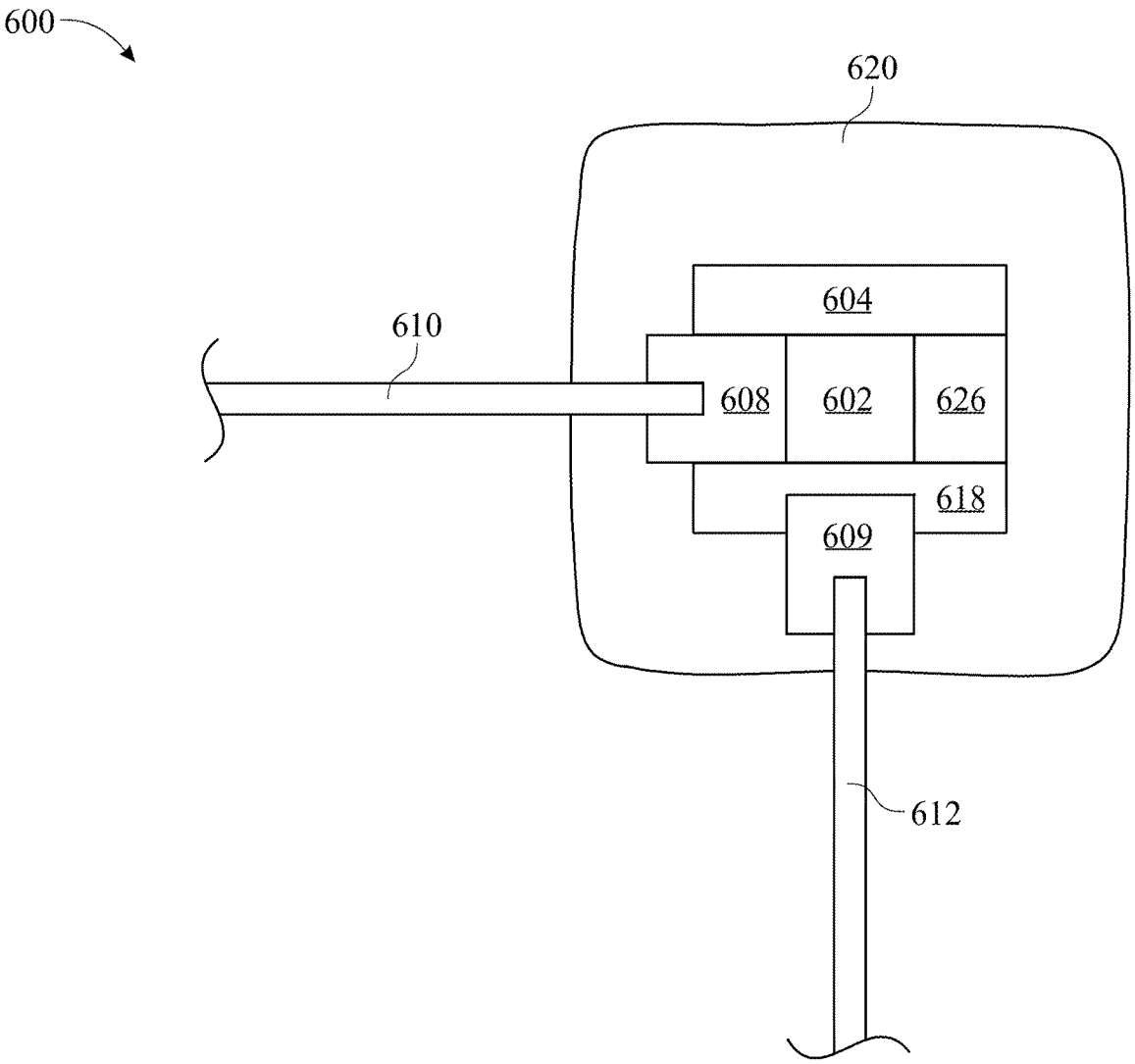
FIG. 6 shows a top view of a fencing system and method in accordance with an embodiment of the invention.

FIG. 6 shows a top view of a fencing intersection 600 of a fencing system and method in accordance with an embodiment of the invention. Fence intersection 600 includes a first vertical post 602 secured at least partially above ground and at least partially below ground using poured cement 620. A first rail member 608 having a first slot running the length of rail member 608 is shown facing horizontally arranged cement composite slats 610. Cement composite slats 610 may have a width of between 0.25 of an inch and 2 inches. The ends of slats 610 are designed to protrude into the first slot of first rail member 608 as shown in FIG. 6. Slots of rail members 608 and 609 may be wider than a width or thickness of the plurality of cement composite slats 610 and 612 allowing the ends of the slats to slide into the slots as shown. Slots of rail members 608 and 609 may have a width of between 0.30 of an inch and 2.25 inches. Rail members 608 and 609 may be made out of a similar concrete composite that the slats 610 and 612 are made from. Each of rail members 608 and 609 may include one or more metal fasteners as integral components of a concrete pour forming rail members 608 and 609. Post 602 may be constructed from one or more materials including steel, steel alloys, aluminum, aluminum alloys, wood, wood product, concrete, concrete products, carbon fiber, polymer based products, or a combination thereof. Adaptor 618 may be used to adapt a corner post 602 to be useable as a ground anchor for multiple fencing sections. Adaptor 618 may be used for a corner intersection with two, three, or four extending fencing sections. In FIG. 6, one adapter was needed for two, or three extending fencing sections. If another fencing section is needed, filler strip 626 may be removed and replaced with another rail member similar to rail member 608. Two adapters 618 would be needed for fencing sections extending in four directions as shown in FIG. 9.

Figure 7:
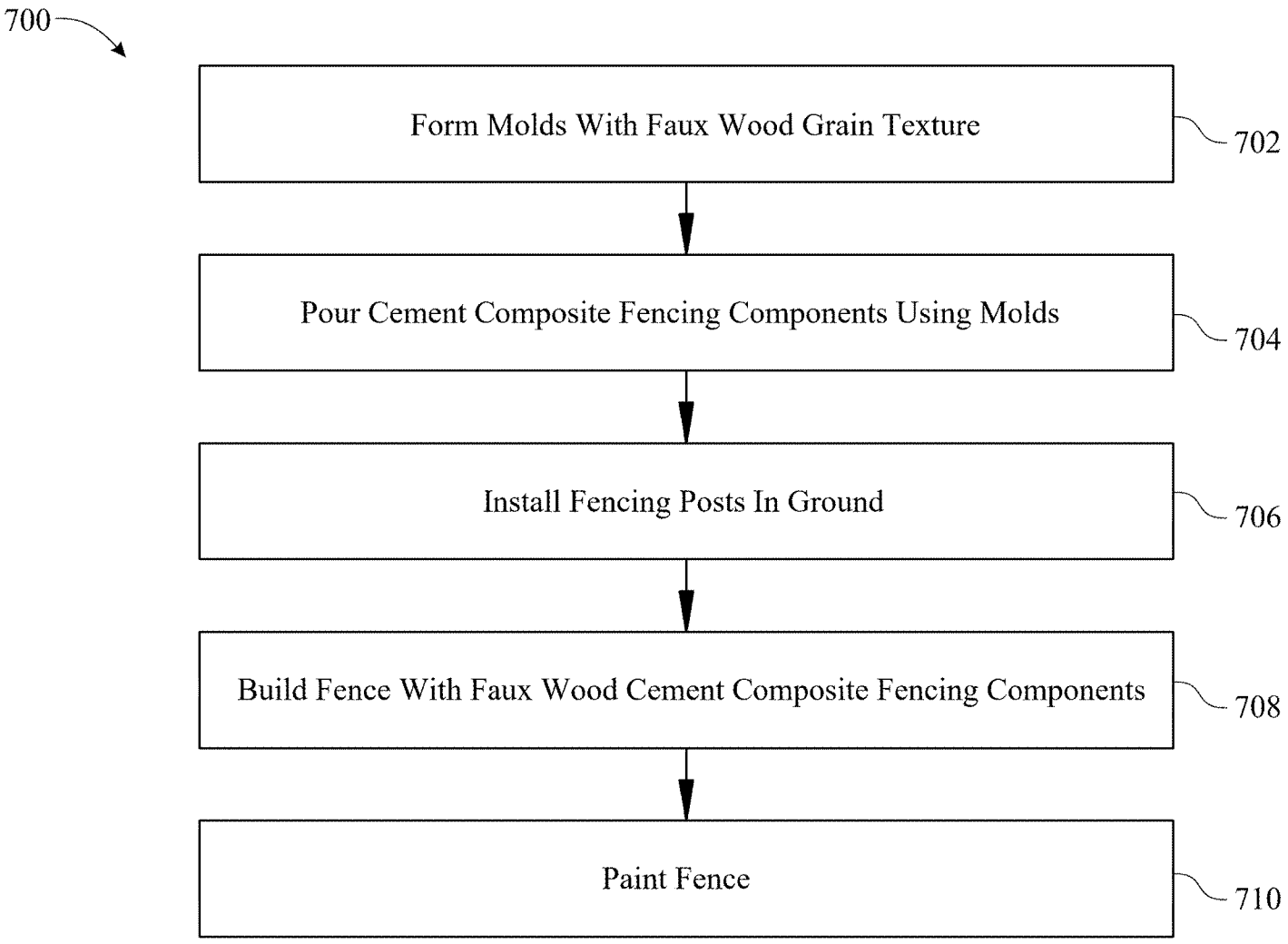
FIG. 7 shows a flow diagram of a fencing system and method in accordance with an embodiment of the invention.

FIG. 7 shows a method flow diagram 700 in accordance with an embodiment of the invention. A method 700 includes forming molds with a faux wood grain texture for all components needed except for the posts 702. Pour cement composite fencing components using the molds 704. Some of the fencing components may include metal fasteners built into the fencing components as shown and described in relation to FIGS. 3 and 5. Once all of the fencing components have been made and cured, posts can be cemented in the ground 706. Next the fence is built using the molded cement composite fencing components 708. Normally, cement fencing is heavy and multiple people and machinery are needed to erect a cement fence. The instant invention uses cement slats, which weigh much less than cement sheets, and can be built easily by a single worker. The fence is built by attached the side rails to the posts and installing the bottom rail. Next the cement slats are slid in place one by one in a horizontal direction on top of each other until a desired height for the top of the fence is reached. The top rail cap is then installed. The facing boards installed and the fence is painted 710.

Figure 8:
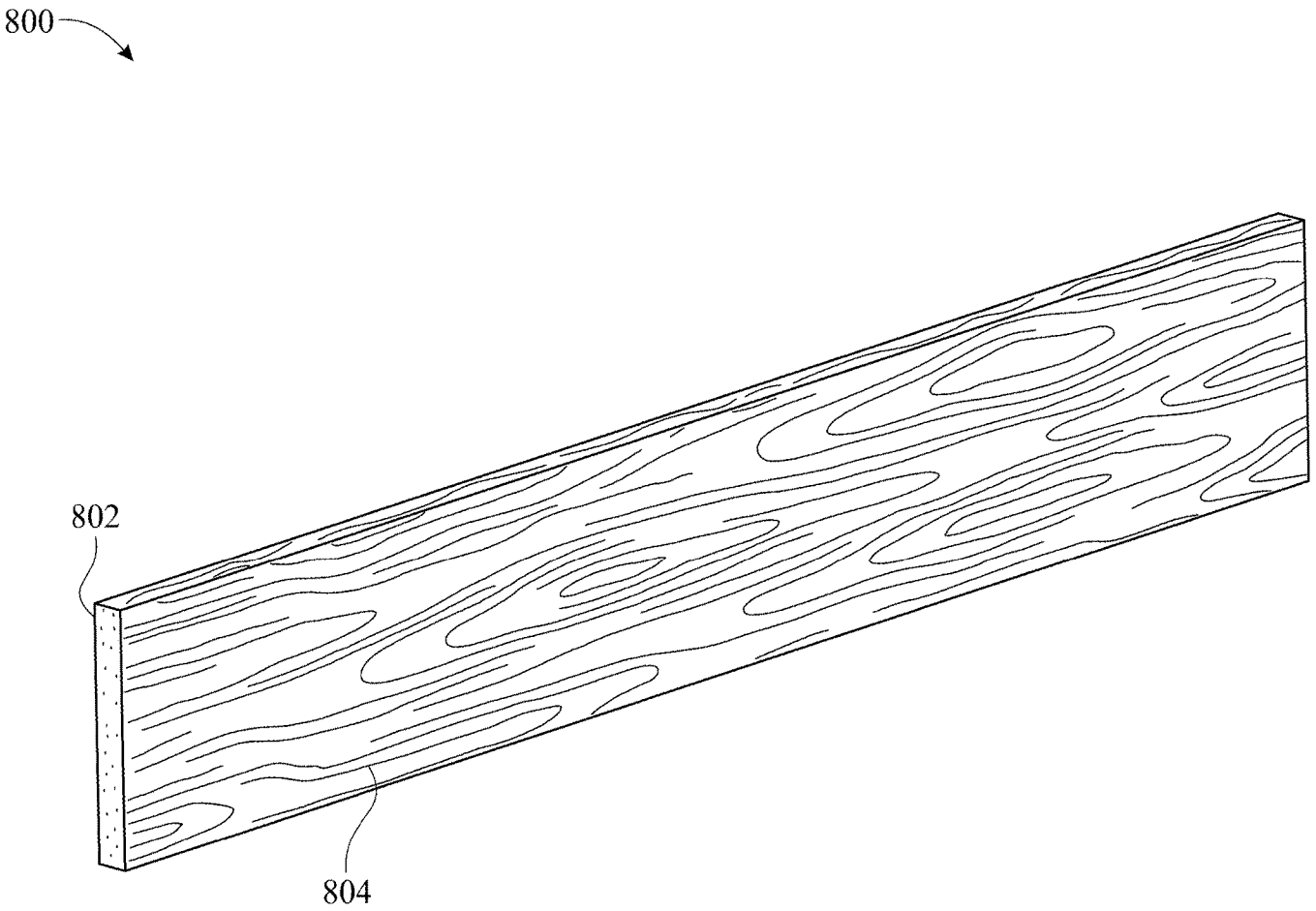
FIG. 8 shows a perspective view of a fencing system and method in accordance with an embodiment of the invention.

FIG. 8 shows a faux wood plank/slat/board 800. Faux wood plank is made from poured composite cement and includes wood grain texture 804. An end 802 of slat 800 is slid into rails of two or more rail members to form a floating wall assembly of the present invention.

Figure 9:
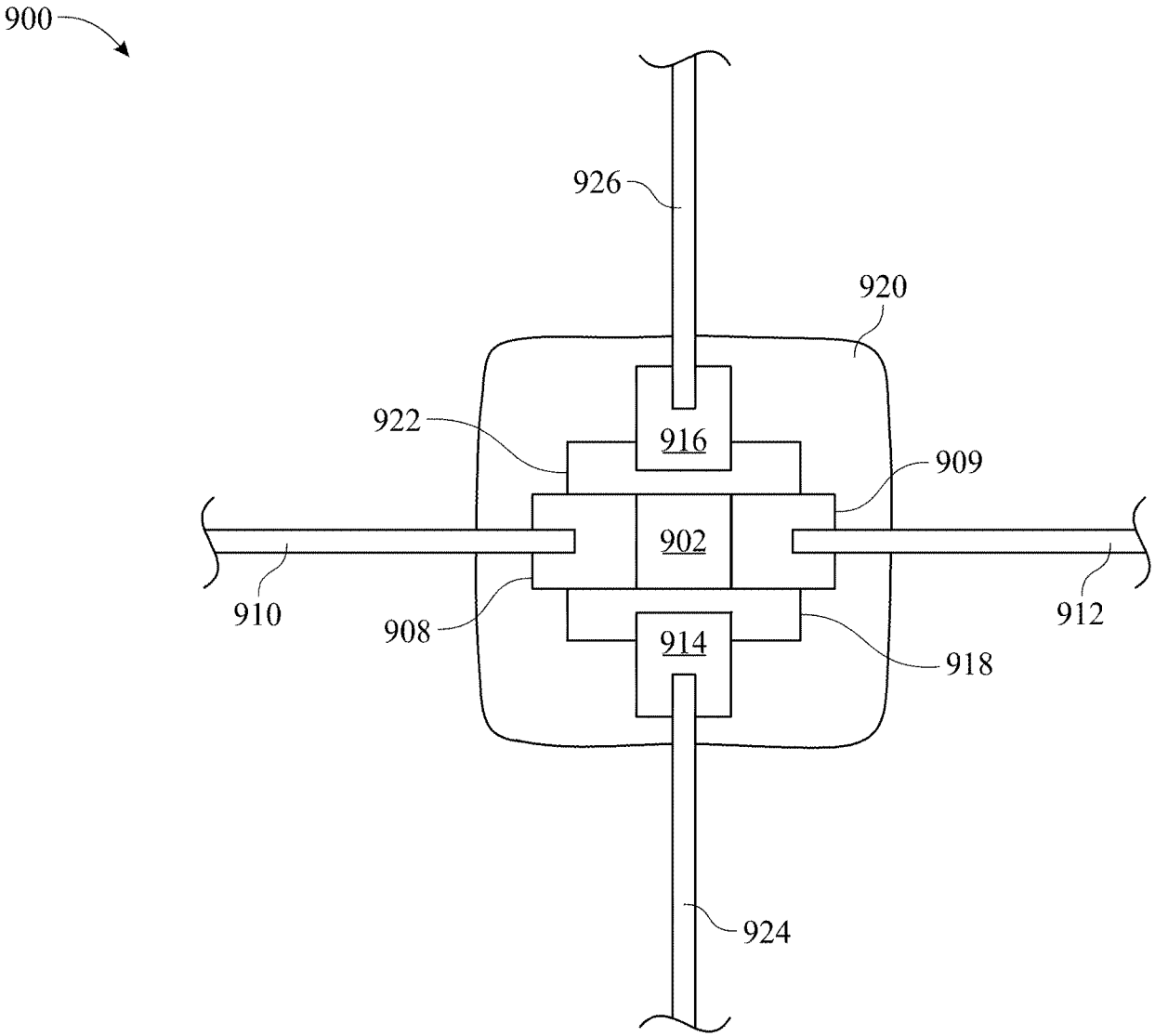
FIG. 9 shows a top view of a fencing system and method in accordance with an embodiment of the invention.

FIG. 9 shows a top view of a fencing intersection 900 of a fencing system and method in accordance with an embodiment of the invention. Fence intersection 900 includes a first vertical post 902 secured at least partially above ground and at least partially below ground using poured cement 920. A first rail member 908 having a first slot running the length of rail member 908 is shown facing horizontally arranged cement composite slats 910. Cement composite slats 910 may have a width of between 0.25 of an inch and 2 inches. The ends of slats 910 are designed to protrude into the first slot of first rail member 908 as shown in FIG. 9. Slots of rail members 908, 909, 914, and 916 may be wider than a width or thickness of the plurality of cement composite slats 910/912/924/926 allowing the ends of the slats to slide into the slots as shown. Slots of rail members 908, 909, 914, and 916 may have a width of between 0.30 of an inch and 2.25 inches. Rail members 908, 909, 914, and 916 may be made out of a similar concrete composite that the slats 910/912/924/926 are made from. Each of rail members 908, 909, 914, and 916 may include one or more metal fasteners as integral components of a concrete pour forming rail members 908, 909, 914, and 916. Post 902 may be constructed from one or more materials including steel, steel alloys, aluminum, aluminum alloys, wood, wood product, concrete, concrete products, carbon fiber, polymer based products, or a combination thereof. Adaptors 918/922 may be used to adapt a corner post 902 to be useable as a ground anchor for multiple fencing sections. Adaptors 918/922 may be used for a corner intersection with two, three, or four extending fencing sections. In FIG. 6, one adapter was needed for two, or three extending fencing sections. Two adapters 918/922 are needed for fencing sections extending in four directions as shown. A plurality of rail members, facing members, horizontal slats, and vertical posts may be used in various fencing arrangements contemplated in accordance with the instant invention.

The systems and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A fencing system comprising:

a first vertical post secured at least partially below ground and extending vertically therefrom;

a second vertical post secured at least partially below the ground and extending vertically therefrom;

a first rail member having a first slot and attached to the first vertical post;

a second rail member having a second slot and attached to the second vertical post;

a third rail member having a third slot;

a fourth rail member having a fourth slot;

a plurality of generally horizontally arranged cement composite slats positioned in a common plane formed by the first slot and the second slot forming a floating arrangement of horizontally positioned cement composite slats, each of the slats extending horizontally between the first and the second posts and having ends extending within the first and the second slots, and the slats are slidable vertically within the first and second slots and touch one another; and wherein the first rail member, the second rail member, the third rail member, and the fourth rail member form a frame for the floating arrangement of horizontally positioned cement composite slats.

2. The fencing system of claim 1, wherein the plurality of generally horizontally arranged cement composite slats have a width of between 0.25 of an inch and 2 inches.

3. The fencing system of claim 2, wherein the first slot, the second slot, the third slot, and the fourth slot have a width of between 0.30 of an inch and 2.25 inches.

4. The fencing system of claim 3 further comprising: a first facing member and a second facing member, wherein the first facing member and the second facing member each provide an interface between the frame and the first vertical post.

5. The fencing system of claim 4 further comprising: a third facing member and a fourth facing member, wherein the third facing member and the fourth facing member each provide an interface between the frame and the second vertical post.

6. The fencing system of claim 5, wherein the first slot and the second slot are attached to the first vertical post and the second vertical post by way of one or more fasteners.

7. The fencing system of claim 6, wherein the first vertical post has a fifth rail member having a fifth slot and attached to the first vertical post.

8. The fencing system of claim 7, wherein the first vertical post has a sixth rail member having a sixth slot and attached to the first vertical post.

9. The fencing system of claim 8, wherein the first vertical post has a seventh rail member having a seventh slot and attached to the first vertical post.

10. The fencing system of claim 9, wherein the second vertical post has an eighth rail member having an eighth slot and attached to the second vertical post.

11. The fencing system of claim 10, wherein the second vertical post has a ninth rail member having a ninth slot and attached to the second vertical post.

12. The fencing system of claim 11, wherein the second vertical post has a tenth rail member having a tenth slot and attached to the second vertical post.

13. The fencing system of claim 12, wherein the first rail member and the second rail member are cement composite materials.

14. The fencing system of claim 13, wherein the third rail member and the fourth rail member are cement composite materials.

15. The fencing system of claim 14, wherein the first facing member and the second facing member are cement composite materials.

16. The fencing system of claim 15, wherein the third facing member and the fourth facing member are cement composite materials.

17. The fencing system of claim 16, wherein the first vertical post and the second vertical post are cemented into the ground.

18. The fencing system of claim 17, wherein the first rail member and the second rail member are cement composite materials formed with one or more embedded metal fasteners.

19. The fencing system of claim 18, wherein the third rail member and the fourth rail member are cement composite materials formed with one or more embedded metal fasteners.

20. The fencing system of claim 19, wherein the plurality of generally horizontally arranged cement composite slats directly touch adjacent slats to form the floating arrangement.

* * * * *